US007280014B2

(12) United States Patent
Potter

(10) Patent No.: US 7,280,014 B2
(45) Date of Patent: Oct. 9, 2007

(54) MICRO-ELECTRO-MECHANICAL SWITCH AND A METHOD OF USING AND MAKING THEREOF

(75) Inventor: Michael D. Potter, Churchville, NY (US)

(73) Assignee: Rochester Institute of Technology, Rochester, NY (US)

( * ) Notice: Subject to any disclaimer, the term of this patent is extended or adjusted under 35 U.S.C. 154(b) by 240 days.

(21) Appl. No.: 10/096,472

(22) Filed: Mar. 12, 2002

(65) Prior Publication Data

US 2002/0131228 A1 Sep. 19, 2002

Related U.S. Application Data

(60) Provisional application No. 60/275,386, filed on Mar. 13, 2001.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | |
|---|---|---|---|
| 2,567,373 | A | 9/1951 | Giacoletto et al. |
| 2,588,513 | A | 3/1952 | Giacoletto |
| 2,978,066 | A | 4/1961 | Nodolf |
| 3,118,022 | A | 1/1964 | Sessler et al. |
| 3,397,278 | A | 8/1968 | Pomerantz |
| 3,405,334 | A | 10/1968 | Jewett et al. |
| 3,487,610 | A | 1/1970 | Brown et al. |
| 3,715,500 | A | 2/1973 | Sessler et al. |
| 3,731,163 | A | 5/1973 | Shuskus |
| 3,742,767 | A | 7/1973 | Bernard et al. |
| 3,786,495 | A | 1/1974 | Spence |
| 3,858,307 | A | 1/1975 | Yoshimura et al. |
| 3,924,324 | A | 12/1975 | Kodera |
| 4,047,214 | A | 9/1977 | Francombe et al. |

(Continued)

FOREIGN PATENT DOCUMENTS

| | | | |
|---|---|---|---|
| JP | 58-029379 | A | 2/1983 |

(Continued)

OTHER PUBLICATIONS

Aguilera et al., "Electron Energy Distribution at the Insulator-Semiconductor Interface in AC Thin Film Electroluminescent Display Devices," *IEEE Transactions on Electron Devices* 41(8):1357-1363 (1994).

(Continued)

*Primary Examiner*—Elvin Enad
*Assistant Examiner*—Bernard Rojas
(74) *Attorney, Agent, or Firm*—Nixon Peabody LLP

(57) ABSTRACT

A micro-electro-mechanical switch includes at least one portion of a conductive line in the chamber, a beam with imbedded charge, and control electrodes. The beam has a conductive section which is positioned in substantial alignment with the at least one portion of the conductive line. The conductive section of the beam has an open position spaced away from the at least one portion of the conductive line and a closed position on the at least one portion of the conductive line. Each of the control electrodes is spaced away from an opposing side of the beam to control movement of the beam.

22 Claims, 15 Drawing Sheets

U.S. PATENT DOCUMENTS

| | | | |
|---|---|---|---|
| 4,102,202 | A | 7/1978 | Ferriss |
| 4,115,914 | A | 9/1978 | Harari |
| 4,126,822 | A | 11/1978 | Wahlstrom |
| 4,160,882 | A | 7/1979 | Driver |
| 4,166,729 | A | 9/1979 | Thompson et al. |
| 4,285,714 | A | 8/1981 | Kirkpatrick |
| 4,288,735 | A | 9/1981 | Crites |
| 4,340,953 | A | 7/1982 | Iwamura et al. |
| 4,375,718 | A | 3/1983 | Wadsworth et al. |
| 4,490,772 | A | 12/1984 | Blickstein |
| 4,504,550 | A | 3/1985 | Pook |
| 4,513,049 | A | 4/1985 | Yamasaki et al. |
| 4,581,624 | A | 4/1986 | O'Connor |
| 4,585,209 | A | 4/1986 | Aine et al. |
| 4,626,263 | A | 12/1986 | Inoue et al. |
| 4,626,729 | A | 12/1986 | Lewiner et al. |
| 4,701,640 | A | 10/1987 | Flygstad et al. |
| 4,716,331 | A | 12/1987 | Higgins, Jr. |
| 4,736,629 | A | 4/1988 | Cole |
| 4,789,504 | A | 12/1988 | Ohmori et al. |
| 4,789,803 | A | 12/1988 | Jacobsen et al. |
| 4,794,370 | A | 12/1988 | Simpson et al. |
| 4,874,659 | A | 10/1989 | Ando et al. |
| 4,905,701 | A | 3/1990 | Cornelius |
| 4,922,756 | A | 5/1990 | Henrion |
| 4,944,854 | A | 7/1990 | Felton et al. |
| 4,945,068 | A | 7/1990 | Sugaya |
| 4,958,317 | A | 9/1990 | Terada et al. |
| 4,965,244 | A | 10/1990 | Weaver et al. |
| 4,996,627 | A | 2/1991 | Zias et al. |
| 4,997,521 | A | 3/1991 | Howe et al. |
| 5,020,030 | A | 5/1991 | Huber |
| 5,050,435 | A | 9/1991 | Pinson |
| 5,054,081 | A | 10/1991 | West |
| 5,057,710 | A | 10/1991 | Nishiura et al. |
| 5,081,513 | A | 1/1992 | Jackson et al. |
| 5,082,242 | A | 1/1992 | Bonne et al. |
| 5,088,326 | A | 2/1992 | Wada et al. |
| 5,092,174 | A | 3/1992 | Reidemeister et al. |
| 5,095,752 | A | 3/1992 | Suzuki et al. |
| 5,096,388 | A | 3/1992 | Weinberg |
| 5,108,470 | A | 4/1992 | Pick |
| 5,112,677 | A | 5/1992 | Tani et al. |
| 5,118,942 | A | 6/1992 | Hamade |
| 5,129,794 | A | 7/1992 | Beatty |
| 5,132,934 | A | 7/1992 | Quate et al. |
| 5,143,854 | A | 9/1992 | Pirrung et al. |
| 5,156,810 | A | 10/1992 | Ribi |
| 5,164,319 | A | 11/1992 | Hafeman et al. |
| 5,180,623 | A | 1/1993 | Ohnstein |
| 5,189,641 | A | 2/1993 | Arakawa |
| 5,207,103 | A | 5/1993 | Wise et al. |
| 5,228,373 | A | 7/1993 | Welsch |
| 5,231,045 | A | 7/1993 | Miura et al. |
| 5,238,223 | A | 8/1993 | Mettner et al. |
| 5,256,176 | A | 10/1993 | Matsuura et al. |
| 5,284,179 | A | 2/1994 | Shikida et al. |
| 5,284,692 | A | 2/1994 | Bell |
| 5,323,999 | A | 6/1994 | Bonne et al. |
| 5,334,238 | A | 8/1994 | Goodson et al. |
| 5,336,062 | A | 8/1994 | Richter |
| 5,336,904 | A | 8/1994 | Kusunoki |
| 5,348,571 | A | 9/1994 | Weber |
| 5,349,492 | A | 9/1994 | Kimura et al. |
| 5,355,577 | A | 10/1994 | Cohn |
| 5,365,790 | A | 11/1994 | Chen et al. |
| 5,367,429 | A | 11/1994 | Tsuchitani et al. |
| 5,380,396 | A | 1/1995 | Shikida et al. |
| 5,392,650 | A | 2/1995 | O'Brien et al. |
| 5,417,235 | A | 5/1995 | Wise et al. |
| 5,417,312 | A | 5/1995 | Tsuchitani et al. |
| 5,419,953 | A | 5/1995 | Chapman |
| 5,441,597 | A | 8/1995 | Bonne et al. |
| 5,445,008 | A | 8/1995 | Wachter et al. |
| 5,474,599 | A | 12/1995 | Cheney et al. |
| 5,488,864 | A | 2/1996 | Stephan |
| 5,491,604 | A | 2/1996 | Nguyen et al. |
| 5,496,507 | A | 3/1996 | Angadjivand et al. |
| 5,512,882 | A | 4/1996 | Stetter et al. |
| 5,519,240 | A | 5/1996 | Suzuki |
| 5,520,522 | A | 5/1996 | Rathore et al. |
| 5,526,172 | A | 6/1996 | Kanack |
| 5,567,336 | A | 10/1996 | Tatah |
| 5,591,679 | A | 1/1997 | Jakobsen et al. |
| 5,593,476 | A | 1/1997 | Coppom |
| 5,593,479 | A | 1/1997 | Frey et al. |
| 5,616,844 | A | 4/1997 | Suzuki et al. |
| 5,635,739 | A | 6/1997 | Grieff et al. |
| 5,640,133 | A | 6/1997 | MacDonald et al. |
| 5,668,303 | A | 9/1997 | Giesler et al. |
| 5,671,905 | A | 9/1997 | Hopkins, Jr. |
| 5,677,617 | A | 10/1997 | Tokai et al. |
| 5,698,771 | A | 12/1997 | Shields et al. |
| 5,739,834 | A | 4/1998 | Okabe et al. |
| 5,747,692 | A | 5/1998 | Jacobsen et al. |
| 5,771,148 | A | 6/1998 | Davis |
| 5,777,977 | A | 7/1998 | Fujiwara et al. |
| 5,788,468 | A | 8/1998 | Dewa et al. |
| 5,793,485 | A | 8/1998 | Gourley |
| 5,798,146 | A | 8/1998 | Murokh et al. |
| 5,807,425 | A | 9/1998 | Gibbs |
| 5,812,163 | A | 9/1998 | Wong |
| 5,839,062 | A | 11/1998 | Nguyen et al. |
| 5,846,302 | A | 12/1998 | Putro |
| 5,846,708 | A | 12/1998 | Hollis et al. |
| 5,871,567 | A | 2/1999 | Covington et al. |
| 5,897,097 | A | 4/1999 | Biegelsen et al. |
| 5,908,603 | A | 6/1999 | Tsai et al. |
| 5,914,553 | A | 6/1999 | Adams et al. |
| 5,919,364 | A | 7/1999 | Lebouitz et al. |
| 5,920,011 | A | 7/1999 | Hulsing, II |
| 5,941,501 | A | 8/1999 | Biegelsen et al. |
| 5,955,932 | A | 9/1999 | Nguyen et al. |
| 5,959,516 | A | 9/1999 | Chang et al. |
| 5,967,163 | A | 10/1999 | Pan et al. |
| 5,969,250 | A | 10/1999 | Greiff |
| 5,971,355 | A | 10/1999 | Biegelsen et al. |
| 5,993,520 | A | 11/1999 | Yu |
| 5,994,982 | A | 11/1999 | Kintis et al. |
| 6,007,309 | A | 12/1999 | Hartley |
| 6,032,923 | A | 3/2000 | Biegelsen et al. |
| 6,033,852 | A | 3/2000 | Andle et al. |
| 6,037,797 | A | 3/2000 | Lagowski et al. |
| 6,048,692 | A | 4/2000 | Maracas et al. |
| 6,051,853 | A | 4/2000 | Shimada et al. |
| 6,089,534 | A | 7/2000 | Biegelsen et al. |
| 6,094,102 | A | 7/2000 | Chang et al. |
| 6,106,245 | A | 8/2000 | Cabuz |
| 6,119,691 | A | 9/2000 | Angadjivand et al. |
| 6,120,002 | A | 9/2000 | Biegelsen et al. |
| 6,123,316 | A | 9/2000 | Biegelsen et al. |
| 6,124,632 | A | 9/2000 | Lo et al. |
| 6,126,140 | A | 10/2000 | Johnson et al. |
| 6,127,812 | A | 10/2000 | Ghezzo et al. |
| 6,149,190 | A | 11/2000 | Galvin et al. |
| 6,168,395 | B1 | 1/2001 | Quenzer et al. |
| 6,168,948 | B1 | 1/2001 | Anderson et al. |
| 6,170,332 | B1 | 1/2001 | MacDonald et al. |
| 6,177,351 | B1 | 1/2001 | Beratan et al. |
| 6,181,009 | B1 | 1/2001 | Takahashi et al. |
| 6,197,139 | B1 | 3/2001 | Ju et al. |
| 6,199,874 | B1 | 3/2001 | Galvin et al. |
| 6,204,737 | B1 | 3/2001 | Ellä |
| 6,214,094 | B1 | 4/2001 | Rousseau et al. |

| | | | | |
|---|---|---|---|---|
| 6,238,946 | B1 | 5/2001 | Ziegler | |
| 6,255,758 | B1 | 7/2001 | Cabuz et al. | |
| 6,265,758 | B1 | 7/2001 | Takahashi | |
| 6,275,122 | B1 | 8/2001 | Speidell et al. | |
| 6,287,776 | B1 | 9/2001 | Hefti | |
| 6,324,914 | B1 | 12/2001 | Xue et al. | |
| 6,336,353 | B2 | 1/2002 | Matsiev et al. | |
| 6,384,353 | B1 * | 5/2002 | Huang et al. | 200/181 |
| 6,393,895 | B1 | 5/2002 | Matsiev et al. | |
| 6,395,638 | B1 | 5/2002 | Linnemann et al. | |
| 6,423,148 | B1 | 7/2002 | Aoki | |
| 6,431,212 | B1 | 8/2002 | Hayenga et al. | |
| 6,469,785 | B1 | 10/2002 | Duveneck et al. | |
| 6,470,754 | B1 | 10/2002 | Gianchandani | |
| 6,485,273 | B1 | 11/2002 | Goodwin-Johansson | |
| 6,496,348 | B2 | 12/2002 | McIntosh | |
| 6,504,118 | B2 * | 1/2003 | Hyman et al. | 200/181 |
| 6,580,280 | B2 | 6/2003 | Nakae et al. | |
| 6,597,560 | B2 | 7/2003 | Potter | |
| 6,626,417 | B2 | 9/2003 | Winger et al. | |
| 6,638,627 | B2 | 10/2003 | Potter | |
| 6,673,677 | B2 | 1/2004 | Hofmann et al. | |
| 6,674,132 | B2 | 1/2004 | Willer | |
| 6,688,179 | B2 | 2/2004 | Potter et al. | |
| 6,707,355 | B1 | 3/2004 | Yee | |
| 6,717,488 | B2 | 4/2004 | Potter | |
| 6,734,770 | B2 * | 5/2004 | Aigner et al. | 335/78 |
| 6,750,590 | B2 | 6/2004 | Potter | |
| 6,773,488 | B2 | 8/2004 | Potter | |
| 6,787,438 | B1 | 9/2004 | Nelson | |
| 6,798,132 | B2 | 9/2004 | Satake | |
| 6,841,917 | B2 | 1/2005 | Potter | |
| 6,842,009 | B2 | 1/2005 | Potter | |
| 6,854,330 | B2 * | 2/2005 | Potter | 73/514.25 |
| 7,195,393 | B2 * | 3/2007 | Potter | 366/114 |
| 7,211,923 | B2 | 5/2007 | Potter | |
| 7,217,582 | B2 | 5/2007 | Potter | |
| 2001/0047689 | A1 | 12/2001 | McIntosh | |
| 2002/0000649 | A1 * | 1/2002 | Tilmans et al. | 257/678 |
| 2002/0012937 | A1 | 1/2002 | Tender et al. | |
| 2002/0072201 | A1 | 6/2002 | Potter | |
| 2002/0131230 | A1 | 9/2002 | Potter | |
| 2002/0182091 | A1 | 12/2002 | Potter | |
| 2002/0185003 | A1 | 12/2002 | Potter | |
| 2002/0187618 | A1 | 12/2002 | Potter | |
| 2002/0197761 | A1 | 12/2002 | Patel et al. | |
| 2003/0079543 | A1 | 5/2003 | Potter | |
| 2003/0079548 | A1 | 5/2003 | Potter et al. | |
| 2003/0080839 | A1 * | 5/2003 | Wong | 335/78 |
| 2003/0081397 | A1 | 5/2003 | Potter | |
| 2003/0112096 | A1 | 6/2003 | Potter | |
| 2003/0201784 | A1 | 10/2003 | Potter | |
| 2004/0023236 | A1 | 2/2004 | Potter et al. | |
| 2004/0113752 | A1 | 6/2004 | Schuster | |
| 2004/0145271 | A1 | 7/2004 | Potter | |
| 2004/0155555 | A1 | 8/2004 | Potter | |
| 2005/0035683 | A1 | 2/2005 | Raisanen | |
| 2005/0044955 | A1 | 3/2005 | Potter | |
| 2005/0079640 | A1 | 4/2005 | Potter | |
| 2005/0186117 | A1 | 8/2005 | Uchiyama et al. | |
| 2005/0205966 | A1 | 9/2005 | Potter | |
| 2006/0131692 | A1 | 6/2006 | Saitoh et al. | |
| 2007/0074731 | A1 | 4/2007 | Potter | |

FOREIGN PATENT DOCUMENTS

| | | |
|---|---|---|
| JP | 62-297534 | 12/1987 |
| JP | 02-219478 A | 9/1990 |
| JP | 4-236172 | 8/1992 |
| JP | 08-308258 A | 11/1996 |
| JP | 2000-304567 A | 11/2000 |

OTHER PUBLICATIONS

Brown, et al., "A Varactor-Tuned RF Filter," *IEEE Trans. on MTT*, pp. 1-4 (1999).

Cass, S., "Large Jobs for Little Devices," *IEEE Spectrum*, pp. 72-73 (2001).

Cui, Z., "Basic Information in Microfluidic System: A Knowledge Base for Microfluidic Devices," retrieved from the internet at http://web.archive.org/web/20011015071501/http://www.ccmicro.rl.ac.uk/info_microfluidics.html (Oct. 15, 2001).

Ilic et al., "Mechanical Resonant Immunospecific Biological Detector," *Appl. Phys. Lett*. 77(3):450-452 (2000).

Ilic et al., "Single Cell Detection with Micromechanical Oscillators," *J. Vac. Sci. Technol. B* 19(6):2825-2828 (2001).

Judy et al., "Surface Machined Micromechanical Membrane Pump," *IEEE*, pp. 182-186 (1991).

Kobayashi et al., "Distribution of Trapped Electrons at Interface State in ACTFEL Devices," *in* Proceedings of the Sixth International Workshop on Electroluminescence, El Paso, Texas, May 11-13, 1992.

Laser & Santiago, "A Review of Micropumps," *J. Micromech. Microeng*. 14:R35-R64 (2004).

Shoji & Esashi, "Microflow Devices and Systems," *J. Micromech. Microeng*. 4:157-171 (1994).

http://ucsub.colorado.edu/~maz/research/background.html [Retrieved from Web site on Apr. 4, 2001].

http://www.eecs.umich.edu/RADLAB/bio/rebeiz/Current_Research.html [Retrieved from Web site on Apr. 4, 2001].

"MEMS Technology Developers," *at* http://www.ida.org/DIVISIONS/std/MEMS/tech_fluids.html [Retrieved from the internet on Jun. 13, 2002].

Tada, Y., "Experimental Characteristics of Electret Generator, Using Polymer Film Electrets," *Jpn. J. Appl. Phys*. 31:846-851 (1992).

Sterken et al., "An Electret-Based Electrostatic μ-Generator," *12th International Conference on Solid State Sensors, Actuators and Microsystems*, pp. 1291-1294, Boston, MA (Jun. 8-12, 2003).

Peano & Tambosso, "Design and Optimization of MEMS Electret-Based Capacitive Energy Scavenger," *J. Microelectromechanical Systems* 14(3):429-435 (2005).

Tada, Y.., "Improvement of Conventional Electret Motors," *IEEE Transactions on Electrical Insulation* 28(3): 402-410 (1993).

Gracewski et al., "Design and Modeling of a Micro-Energy Harvester Using an Embedded Charge Layer," *J. Micromech. Microeng*. 16:235-241 (2006).

Jefimenko & Walker, "Electrostatic Current Generator Having a Disk Electret as an Active Element," *Transactions on Industry Applications* 1A-14(6):537-540 (1978).

Genda et al., "High Power Electrostatic Motor and Generator Using Electrets," *12th International Conference on Solid State Sensors, Actuators and Microsytems*, pp. 492-495, Boston, MA (Jun. 8-12, 2003).

* cited by examiner

MICRO-ELECTRO-MECHANICAL SWITCH AND A METHOD OF USING AND MAKING THEREOF

The present invention claims the benefit of U.S. Provisional Patent Application Ser. No. 60/275,386, filed Mar. 13, 2001, which is hereby incorporated by reference in its entirety.

FIELD OF THE INVENTION

This invention relates generally to switches and, more particularly, to a micro-electro-mechanical switch (MEMS) and a method of using and making thereof.

BACKGROUND OF THE INVENTION

Micro-electro-mechanical switches are operated by an electrostatic charge, thermal, piezoelectric or other actuation mechanism. Application of an electrostatic charge to a control electrode in the MEMS causes the switch to close, while removal of the electrostatic charge on the control electrode, allowing the mechanical spring restoration force of the armature to open the switch. Although these MEMS switches work problems have prevented their more widespread use.

For example, one problem with cantilever type MEMS is that they often freeze into a closed position due to a phenomenon known as stiction. These cantilever type MEMS may be actuated by electrostatic forces, however there is no convenient way to apply a force in the opposite direction to release the MEMS to the open position.

One solution to this problem is a design which uses electrostatic repulsive forces to force apart MEMS contacts, such as the one disclosed in U.S. Pat. No. 6,127,744 to R. Streeter et al. which is herein incorporated by reference. In this design, the improved switch includes an insulating substrate, a conductive contact, a cantilever support, a first conductive surface and a cantilever beam. Additionally, a first control surface is provided on the lower surface of and is insulated from the beam by a layer of insulation. A second control surface is disposed over and is separated from the first conductive surface by a layer of insulative material. A variable capacitor is formed by the two control surfaces and the dielectric between them. This capacitor must be considered in addition to the capacitors formed by the first control surface, the layer of insulation and the beam and by the second control surface, the layer of insulation and the first conductive surface.

Unfortunately, there are drawbacks to this design. As discussed above, the additional layers used for attraction or repulsion charge form capacitors which require additional power for operation and thus impose a serious limitation on this type of design. These additional layers also add mass that limits the response time of the switch. Further, this design results in a variable parasitic capacitor between the cantilever beam and contact post.

SUMMARY OF THE INVENTION

A switch in accordance with one embodiment of the present invention includes at least one portion of a conductive line in the chamber, a beam with imbedded charge, and control electrodes. The beam has a conductive section which is positioned in substantial alignment with the at least one portion of the conductive line. The conductive section of the beam has an open position spaced away from the conductive line and a closed position on the conductive line. Each of the control electrodes is spaced away from an opposing side of the beam to control movement of the beam.

A method for making a switch in accordance with another embodiment of the present invention includes forming a chamber in a switch housing, forming separated portions of a conductive line in the chamber, forming a beam with imbedded charge which extends into the chamber, and forming a pair of control electrodes spaced away from opposing sides of the beam. The beam has a conductive section located at or adjacent an edge of the beam and which is positioned in substantial alignment with the separated portions of the conductive line. The conductive section of the beam has an open position spaced away from the separated portions of the conductive line and a closed position on a part of each of the separated portions of the conductive line to couple the separated portions of the conductive line together.

A method of using a switch in accordance with another embodiment of the present invention includes applying a first potential to control electrodes and moving a conductive section on a beam to one of an open position spaced away from at least one portion of a conductive line or a closed position on the at least one portion of the conductive line in response to the applied first potential. The beam has imbedded charge and a conductive section that is located at or adjacent an edge of the beam and is positioned in substantial alignment with the at least one portion of a conductive line. Each of the control electrodes is spaced away from an opposing side of the beam to control movement of the beam.

A method for making a switch in accordance with another embodiment of the present invention includes forming at least one portion of a conductive line, forming a beam with imbedded charge, and forming control electrodes. The beam has a conductive section which is positioned in substantial alignment with the at least one portion of the conductive line. The conductive section of the beam has an open position spaced away from the at least one portion of the conductive line and a closed position on the at least one portion of the conductive line. Each of the control electrodes is spaced away from an opposing side of the beam to control movement of the beam.

A method for making a switch in accordance with another embodiment of the present invention includes filling at least three trenches in a base material with a first conductive material. The first conductive material in two of the trenches forms separated portions of a conductive line and the first conductive material in the other trench forms a first control electrode. A first insulating layer is deposited on at least a portion of the first conductive material and the base material. A trench is formed in a portion of the first insulating layer which extends to at least a portion of the first conductive material in the trenches in the base material. The trench in the portion of the first insulating layer is filled with a first sacrificial material. A trench is formed in the first sacrificial material which is at least partially in alignment with at least a portion of the first conductive material in the trenches in the base material that form the separated portions of the conductive line. The trench in the first sacrificial material is filled with a second conductive material to form a contactor. A charge holding beam is formed over at least a portion of the first insulating layer, the first sacrificial material, and the second conductive material in the trench in the first sacrificial material. The beam is connected to the beam. A second insulating layer is deposited over at least a portion of the beam, the first sacrificial material, and the first insulating layer. A trench is formed in the second insulating layer which extends to at least a portion of the beam and the first sacrificial material. The trench in the second insulating layer is filled with a second sacrificial material. A charge is inbedded on the beam. A third conductive material is deposited over at least a portion of the second insulating layer and the second sacrificial material. A second control electrode is formed from the third conductive material over at least a portion of the second insulating layer and the second sacrificial material. A third insulating layer is deposited over at least a portion of the second control electrode, the second sacrificial material, and the second insulating layer. At least one access hole is formed to the first and second sacrificial materials. The first and second sacrificial materials are removed to form a chamber and sealing the access hole to form a vacuum or a gas filled chamber.

The present invention provides a switch that utilizes fixed static charge to apply attractive and repulsive forces for activation. With the present invention, the parasitic capacitance is minimal, while the switching speed or response is high. The switch does not add extra mass and only requires one power supply. The present invention can be used in a variety of different applications, such as wireless communications, cell phones, robotics, micro-robotics, and/or autonomous sensors.

DETAILED DESCRIPTION

Figure 1:
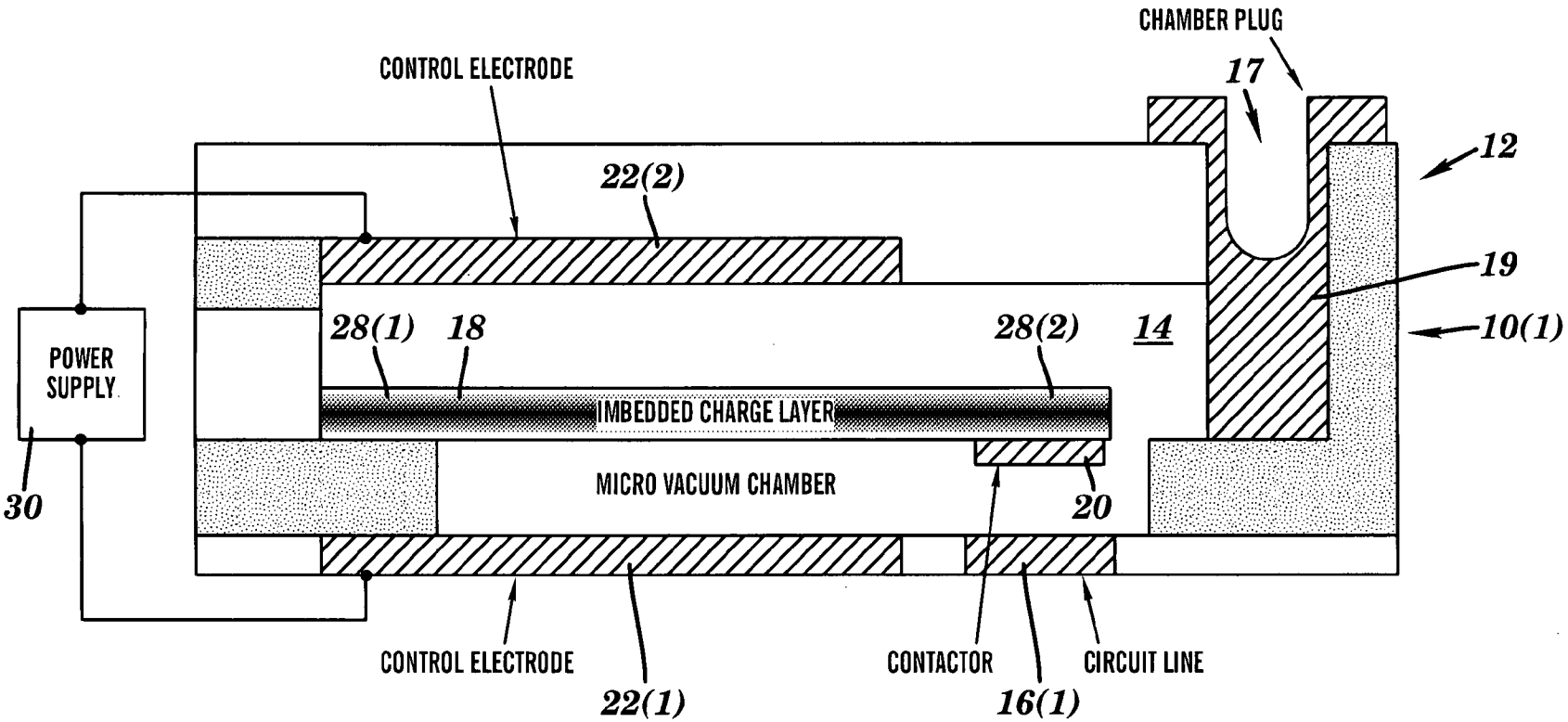
FIG. 1 is a cross sectional, side view of a switch in accordance with one embodiment of the present invention.

A switch 10(1) in accordance with at least one embodiment of the present invention is illustrated in FIG. 1. The switch 10(1) includes a switch housing 12 with a chamber 14, separated portions of a conductive line 16(1) and 16(2), a beam 18 with imbedded charge and a contactor 20, and control electrodes 22(1) and 22(2). The present invention provides a switch 10(1) that utilizes fixed static charge to apply attractive and repulsive forces for activation of the switch and to overcome stiction. This switch 10(1) has lower power requirements to operate, less parasitic capacitance, less mass, and faster switching speed or response than prior designs.

Referring more specifically to FIG. 1, the switch housing 12 defines a chamber 14 in which the switch 10(1) is located. The switch housing 12 is made of several layers of an insulating material, such as silicon dioxide, although other types of materials can be used and the switch housing 12 could comprise a single layer of material in which the chamber 14 is formed. The chamber 14 has a size which is sufficiently large to hold the components of the switch 10(1), although the chamber 14 can have other dimensions. By way of example only, the control electrodes 22(1) and 22(2) in the switch housing 12 may be separated from each other by a distance of about one micron with each of the control electrodes 22(1) and 22(2) spaced from the beam 18 by about 0.5 microns, although these dimensions can vary based on the particular application. The chamber 14 has an access hole 17 used in removing sacrificial material from the chamber 14 although the chamber 14 can have other numbers of access holes. A plug 19 seals the access hole 17. In this embodiment, the chamber 14 is vacuum sealed, although it is not required. The switch housing 12 is vacuum sealed which helps to protect the switch 10(1) from contaminates which, for example, might be attracted and adhere to the beam 18 with the imbedded charge.

Figure 4:
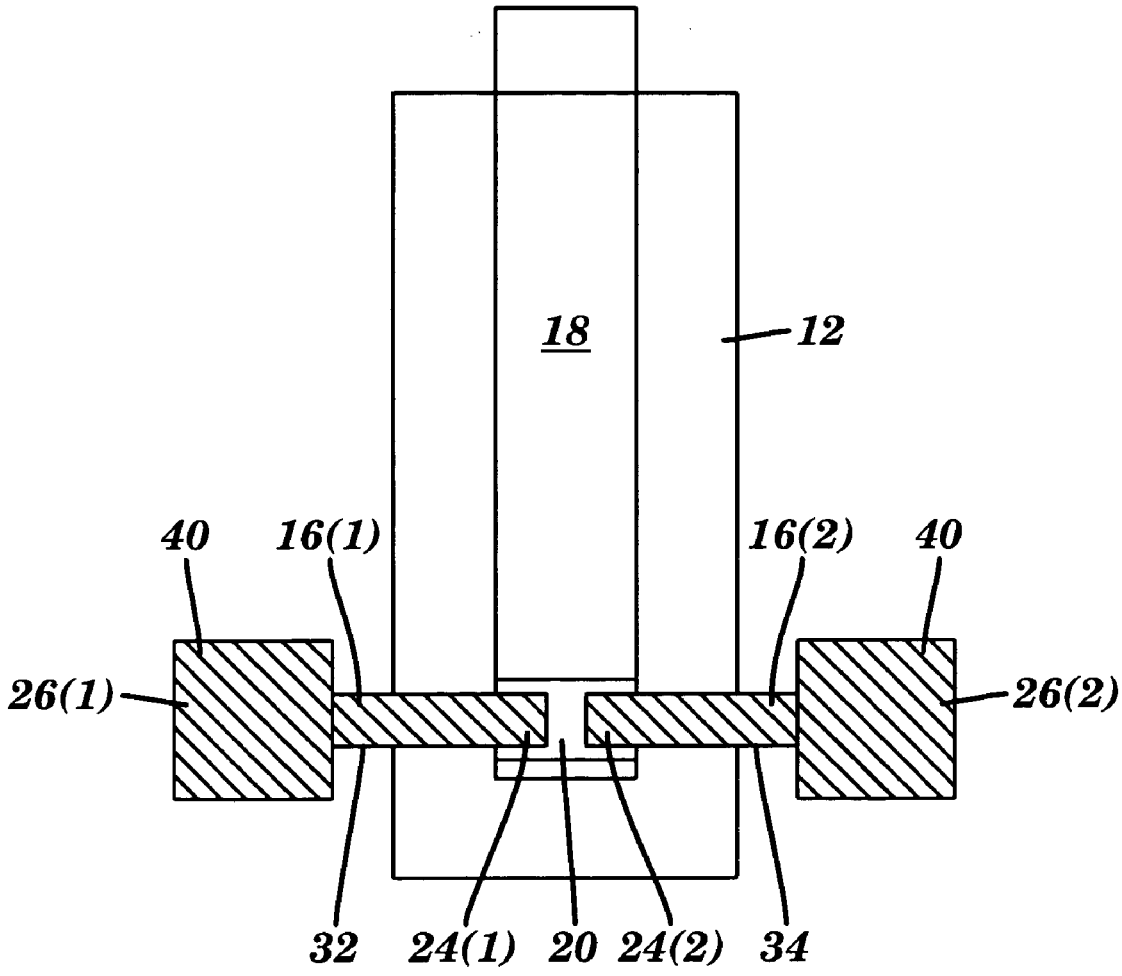
FIG. 4 is a partial, cross sectional, top-view of a step in the method of making the switch.

Referring to FIGS. 1 and 4, each of the separated portions 16(1) and 16(2) of the conductive line or conductor has an end 24(1) and 24(2) which is adjacent to and spaced from the other end 24(1) and 24(2) in the chamber 14 to form an open circuit along the conductive line. The other end 26(1) and 26(2) of each of the separated portions of the conductive line extends out from the chamber to form a contact pad. The separated portions 16(1) and 16(2) of the conductive line are made of a conductive material, such as copper, although another material or materials could be used.

Referring back to FIG. 1, the beam 18 has one end 28(1) which is secured to the switch housing 12 and the other end 28(2) of the beam 18 extends into the chamber 14 and is spaced from the other side of the chamber 14, although other configurations for the beam 18 can be used. For example, both ends 28(1) and 28(2) of the beam 18 could be secured to the switch housing 12, although this embodiment would provide less flexibility than having the beam 18 secured at just one end 28(1) to the switch housing 12 as shown in FIGS. 1 and 2. The beam 18 is made of a material which can hold an imbedded charge. In this particular embodiment, the beam 18 is made of a composite of silicon oxide and silicon nitride, although the beam 18 could be made of another material or materials. By way of example, the beam 18 could be a composite of a plurality of layers of different materials.

Referring to FIGS. 1 and 4, the contactor 20 is located at or adjacent one end 28(2) of the beam 18, although the contactor 20 could be located in other locations or could be part of the end 28(1) or another section of the beam 18 that was made conductive. The contactor 20 is positioned on the beam 18 to be in substantial alignment with the ends 24(1) and 24(2) of the separated portions 16(1) and 16(2) of the conductive line. In this particular embodiment, the contactor 20 is made of a conductive material, such as copper, although another material or materials could be used. In an open position, the contactor 20 is spaced away from the ends 24(1) and 24(2) of the separated portions 16(1) and 16(2) of the conductive line and in a closed position the contractor 20 is located on the ends 24(1) and 24(2) of each of the separated portions 16(1) and 16(2) of the conductive line to couple the separated portions 16(1) and 16(2) of the conductive line together.

Referring back to FIG. 1, the control electrodes 22(1) and 22(2) are located in the chamber 14 of the switch housing 12 and are spaced away from opposing sides of the beam 18, although other configurations are possible. For example, one of the control electrodes 22(1) could be located outside of the chamber 14, as shown in the switch 10(2) in FIG. 2 or both of the control electrodes 22(1) and 22(2) could be located outside of the chamber 14. Each of the control electrodes 22(1) and 22(2) is made of a conductive material, such as chrome, although another material or materials could be used. A power supply 30 is coupled to each of the control electrodes 22(1) and 22(2) and is used to apply the potential to the control electrodes 22(1) and 22(2) to open and close the switch 10(1).

The operation of the switch 10(1) will now be described with reference to FIG. 1. The switch 10(1) is operated by applying a potential across the control electrodes 22(1) and 22(2). When a potential is applied across the control electrodes 22(1) and 22(2), the beam 18 with the imbedded charge is drawn towards one of the control electrodes 22(1) or 22(2) depending on the polarity of the applied potential. This movement of the beam 18 towards one of the control electrodes 22(1) or 22(2) moves the contactor 20 to a closed position resting on ends 24(1) and 24(2) of each of the separated portions 16(1) and 16(2) of the conductive line to couple them together. When the polarity of the applied potential is reversed, the beam 18 is repelled away from the control electrode 22(1) or 22(2) moving the contactor 20 to an open position spaced from the ends 24(1) and 24(2) of each of the separated portions 16(1) and 16(2) of the conductive line to open the connection along the conductive line. Accordingly, the switch 10(1) is controlled by electrostatic forces that can be applied to both close and to open the switch 10(1). No extraneous current path exists, the energy used to open and close the switch is limited to capacitively coupled displacement current, and the dual force directionality overcomes stiction.

Figure 2A:
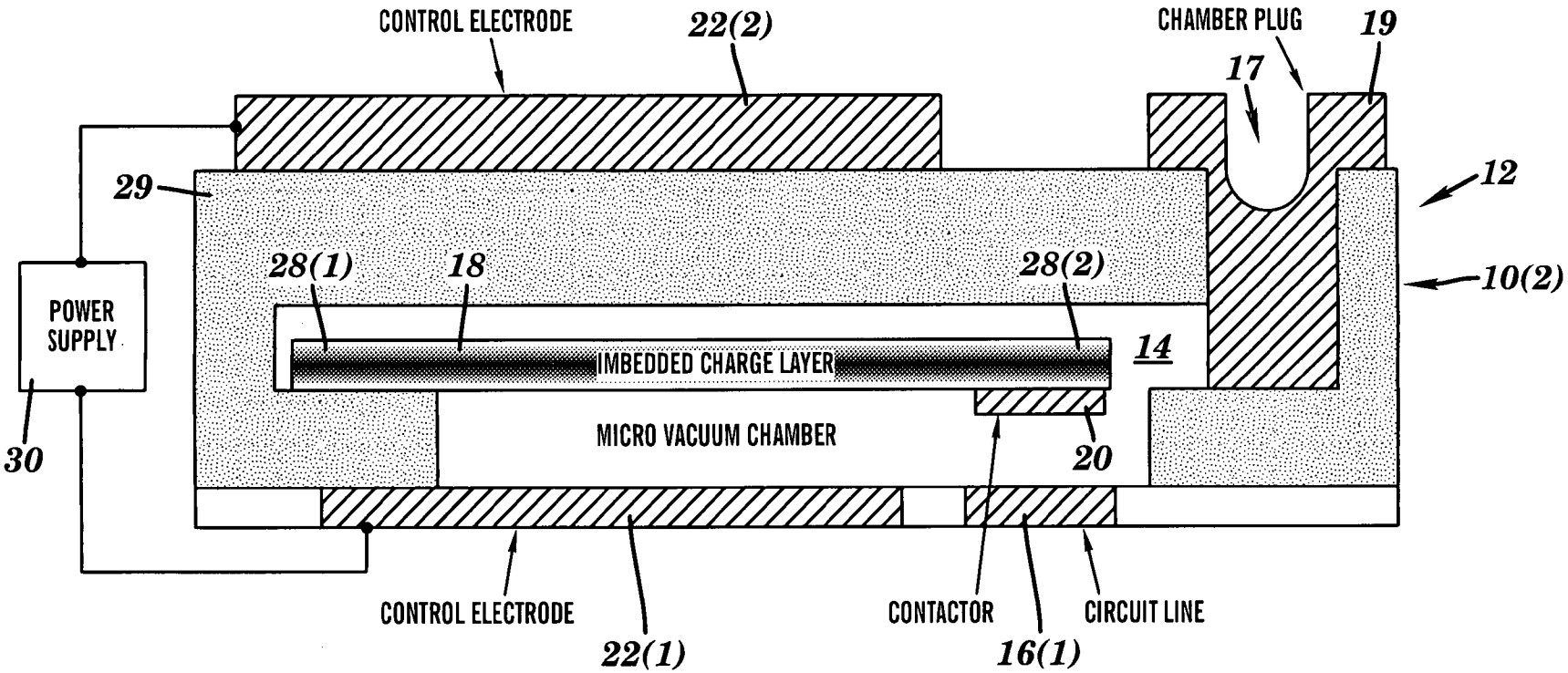
FIG. 2A is a cross sectional, side view of a switch in accordance with another embodiment of the present invention.
Figure 2B:
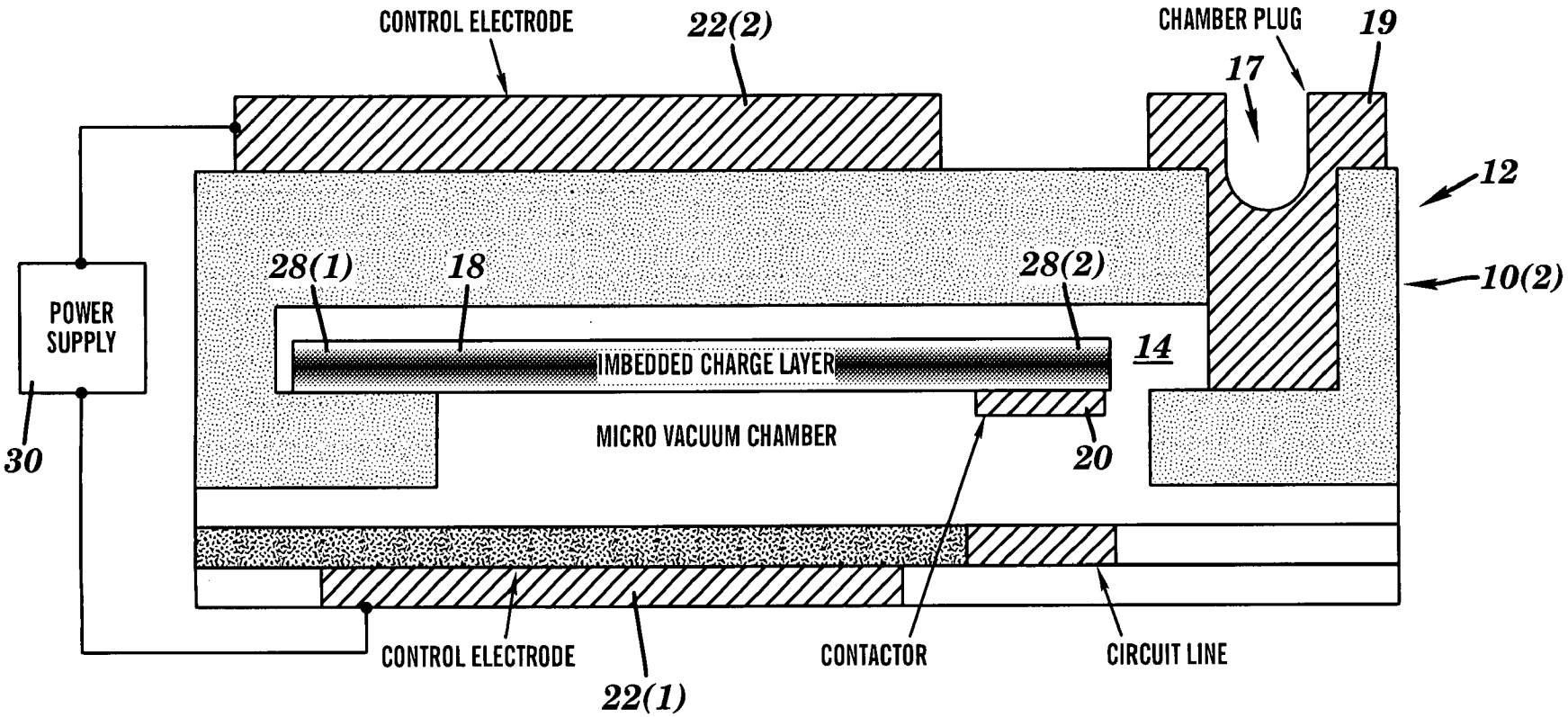
FIG. 2B is a cross sectional, side view of a switch in accordance with yet another embodiment of the present invention.

The components and operation of the switches 10(2) 10(3), and 10(4) shown in FIGS. 2A and 2B are identical to those for the switch 10(1) shown and described with reference FIG. 1, except as described and illustrated herein. Components in FIGS. 2A and 2B which are identical to components in FIG. 1 have the same reference numeral as those in FIG. 1. In FIG. 2A, control electrode 22(2) is located outside of the chamber 14. A portion 29 of the switch housing 12 separates the control electrode 22(2) from the chamber 14. In this embodiment, portion 29 is made of an insulating material although another material or materials could be used. In an alternative embodiment, control electrode 22(1) could be outside of chamber 14 and control electrode 22(2) could be inside chamber 14. In FIG. 2B, control electrodes 22(1) and 22(2) are located outside of the chamber 14. Portions 29 and 31 of the switch housing 12 separate the control electrodes 22(1) and 22(2) from the chamber 14. In this embodiment, portions 29 and 31 of the switch housing 12 are each made of an insulating material, although another material or materials could be used.

Figure 3:
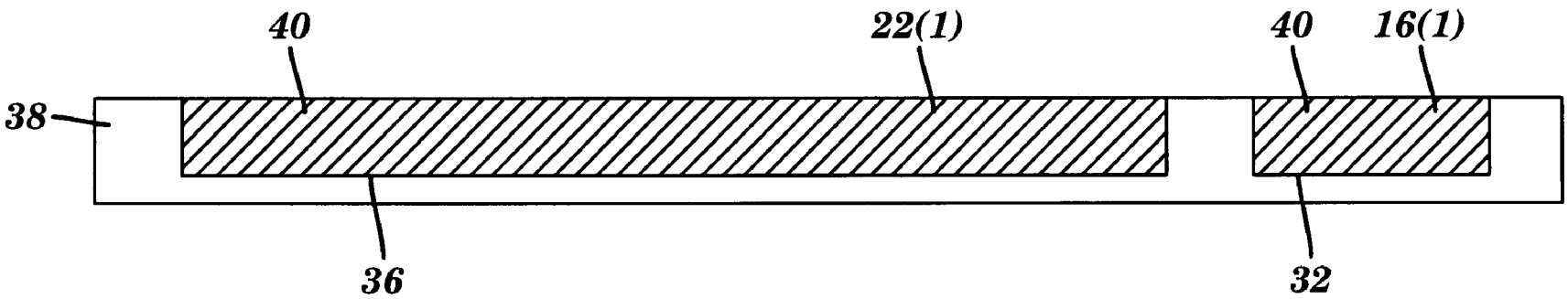
FIGS. 3 and 5-11 are cross sectional, side views of steps in a method of making a switch in accordance with another embodiment of the present invention.

Referring to FIGS. 3-14, a method for making a switch 10(1) in accordance with at least one embodiment will be described. Referring more specifically to FIGS. 3 and 4, three trenches 32, 34, and 36 are etched into a base material 38. Two of the etched trenches 32 and 34 have ends located adjacent and spaced from each other and are used in the forming the separated portions 16(1) and 16(2) of the conductive line. The other trench 36 is used to form one of the control electrodes 22(1). Although etching is used in this particular embodiment to form the trenches 32, 34, and 36, other techniques for forming the trenches or opening can also be used.

Next, a conductive material 40 is deposited in the trenches in the base material 38. The conductive material 40 in the two trenches 32 and 34 with the adjacent ends forms the separated portions 16(1) and 16(2) of the conductive line. The conductive material 40 in the other trench 36 forms control electrode 22(1). Next, the conductive material 40 deposited in these trenches 32, 34, and 36 may also be planarized. Again although in this embodiment, the control electrodes 22(1) is formed in the chamber 14 of the switch housing 12, the control electrode 22(1) could be positioned outside of the switch housing 12.

Figure 5:
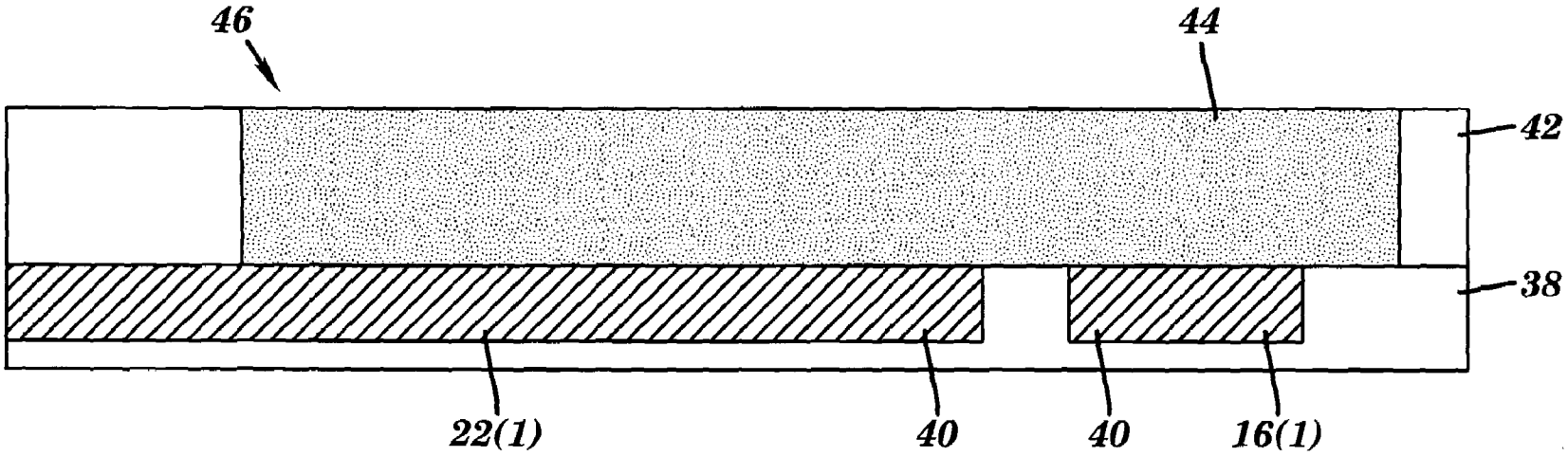

Referring to FIG. 5, once the separated portions 16(1) and 16(2) of the conductive line and the control electrode 22(1) are formed, an insulating material 42 is deposited over the base material 38 and the conductive material 40 in the trenches 32, 34, and 36. In this particular embodiment, silicon dioxide, $SiO_2$, is used as the insulating material 42, although other types of insulating materials can be used.

Once the insulating material 42 is deposited, the insulating material 42 is etched to extend down to a portion of the conductive material 40 in the trenches 32, 34, and 36. Next, a sacrificial material 44 is deposited in the etched opening or trench 46 in the insulating material. In this particular embodiment, polysilicon is used as the sacrificial material 44, although another material or materials can be used. Next, the sacrificial material 44 may be planarized. Although etching is used in this particular embodiment to form opening or trench 46, other techniques for forming trenches or openings can be used.

Figure 6:
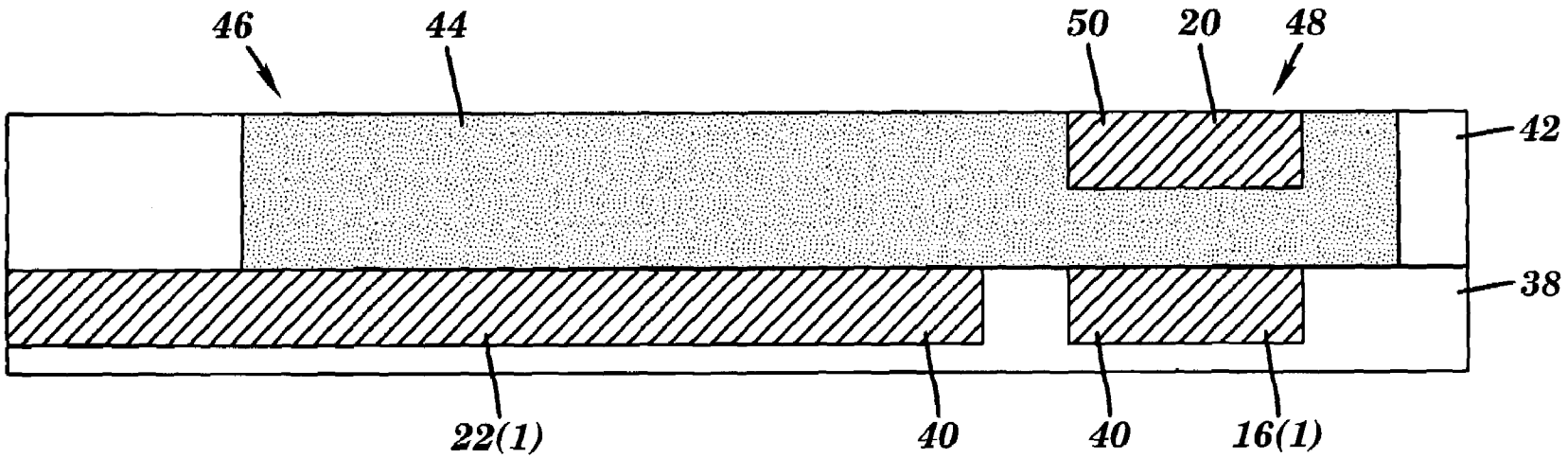

Referring to FIG. 6, once the sacrificial material 44 is deposited, a trench 48, is etched into the sacrificial material 44 at a location which is in alignment with a portion of the conductive material 40 in the trenches that form the separated portions 16(1) and 16(2) of the conductive line. A conductive material 50 is deposited in the trench 48 in the sacrificial material 44 to form a contactor 20. Next, the conductive material 50 may be planarized. Although etching is used in this particular embodiment to form opening or trench 48, other techniques for forming trenches or openings can be used.

Figure 7:
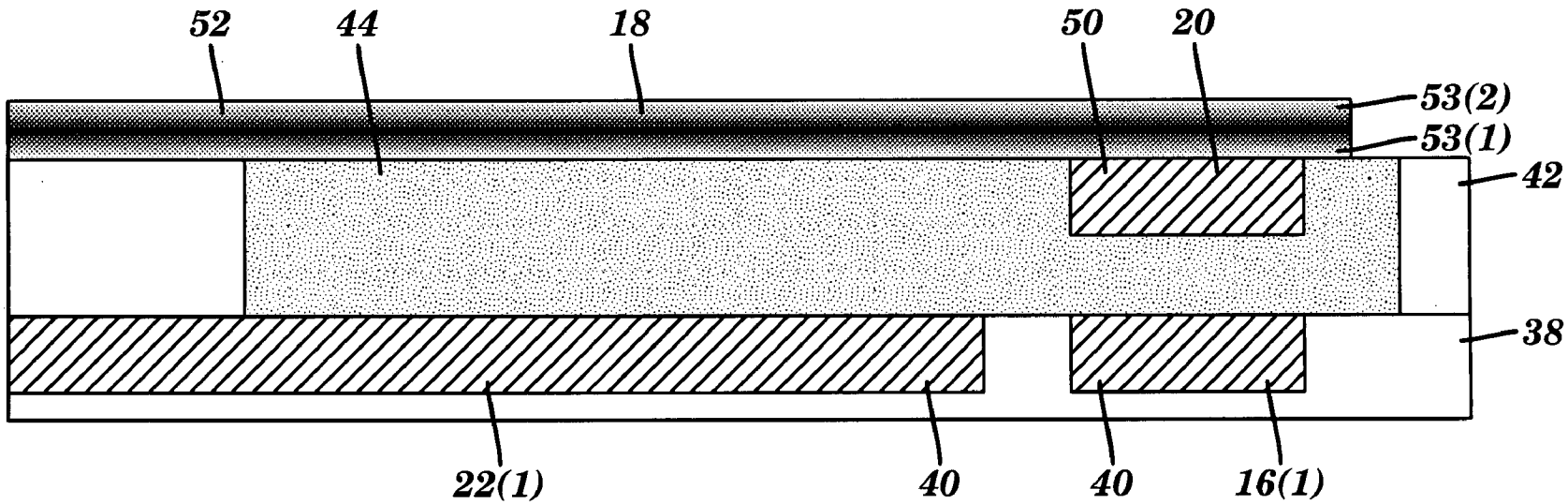

Referring to FIGS. 4 and 7, once the contactor 20 is formed, an insulator 52 comprising a pair of insulating layers 53(1) and 53(2) are deposited over the insulating material 42, the sacrificial material 44, and the conductive material 44 that forms the contactor 20. The insulator 52 is patterned to form a cantilever charge holding beam 18 which extends from the insulating layer 42 across a portion of the sacrificial layer 44 and is connected to the contactor 20. Although in this particular embodiment the beam 18 is patterned, other techniques for forming the beam 18 can be used. Additionally, although in this embodiment insulator 52 comprises two insulating layers, insulator 52 can be made of more or fewer layers and can be made of another material or materials that can hold fixed charge.

Figure 8:
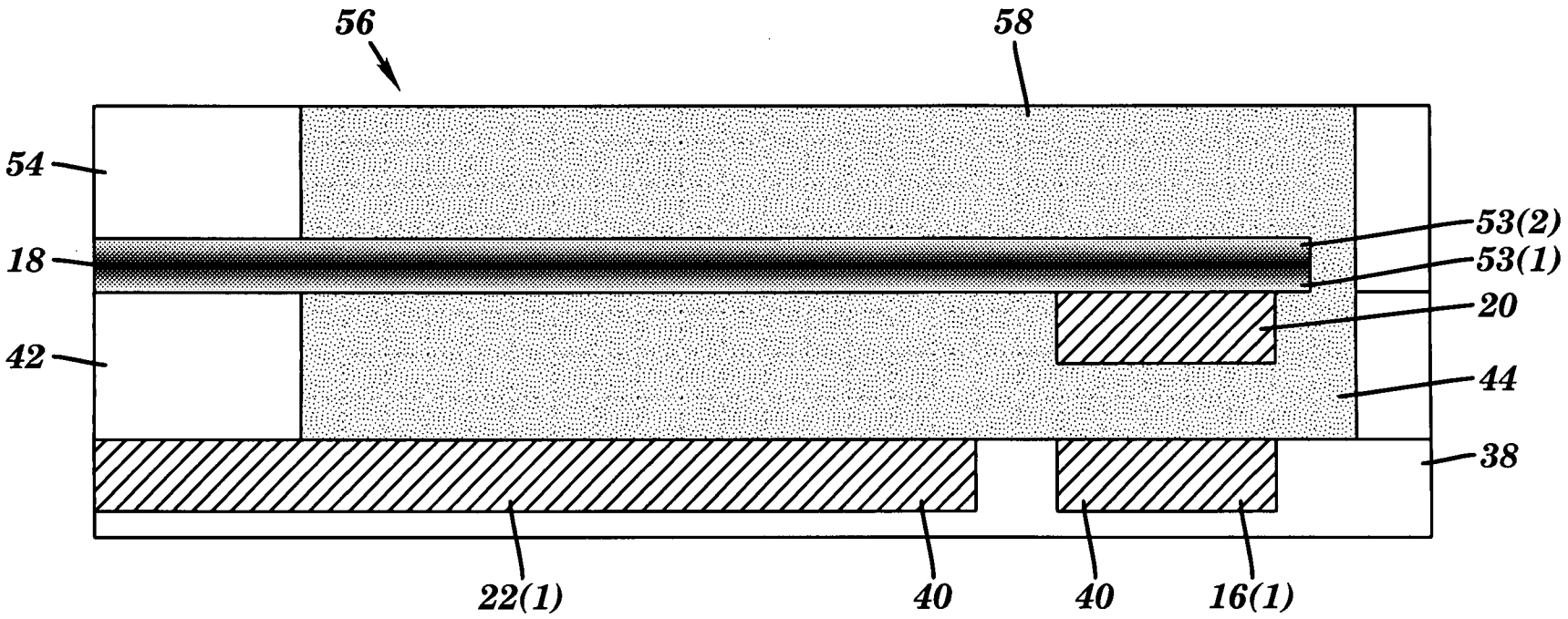

Referring to FIG. 8, once the beam 18 is formed, an insulating material 54 is deposited over the insulating material 42, the beam 18, and the sacrificial material 44. A trench 56 is etched into the insulating material 54 which extends down to a portion of the beam 18 and the sacrificial material 44. A sacrificial material 58 is deposited in the trench 56 in the insulating material 54. The sacrificial material 58 can be planarized. Sacrificial material 58 can be made of the same or a different material from sacrificial layer 44 and in this embodiment is polysilicon, although another material or materials could be used. Although etching is used in this particular embodiment to form opening or trench 56, other techniques for forming trenches or openings can be used.

Figure 9:
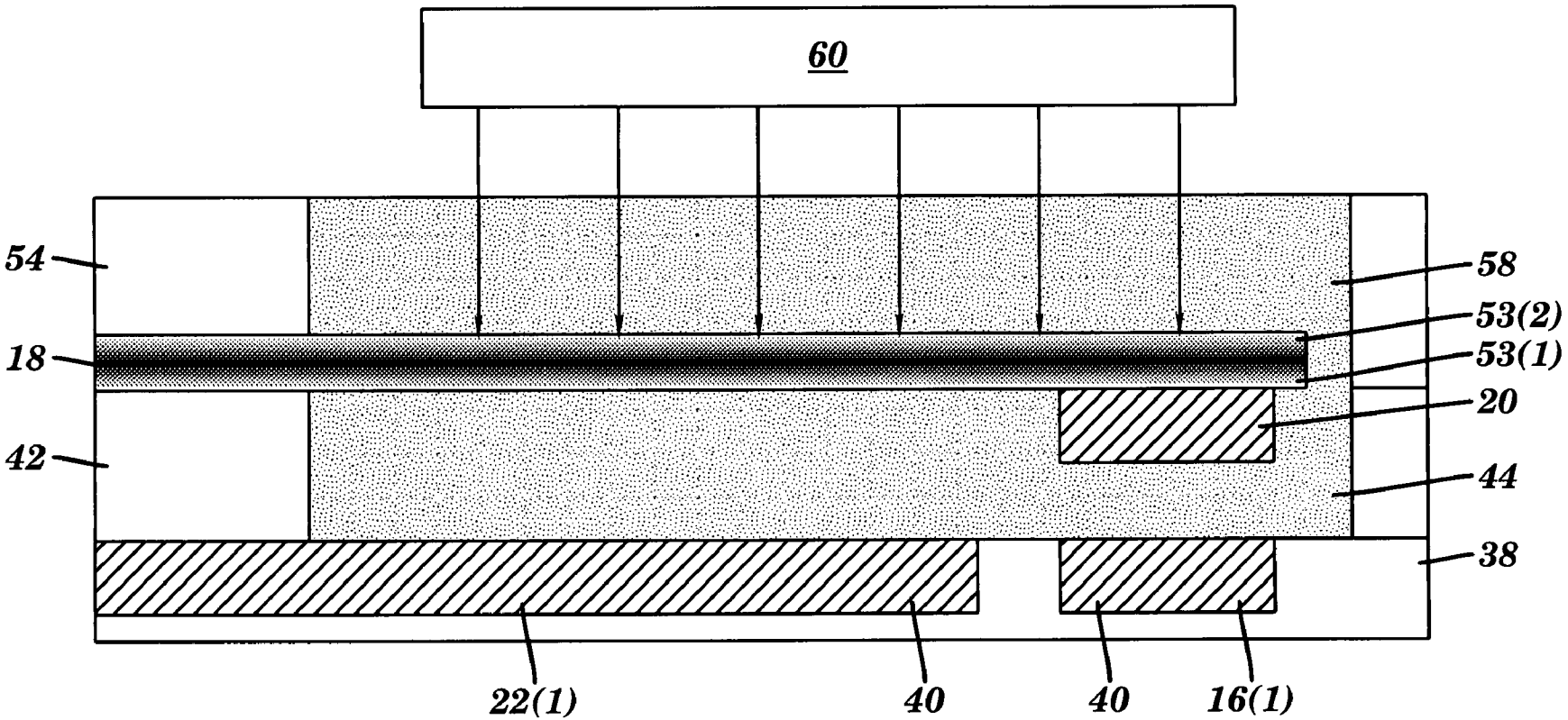

Referring to FIG. 9, electrons are injected into the beam 18 from a ballistic energy source 60 to imbed charge in the beam 18, although other techniques for imbedding the electrons can be used, such as applying an electrical bias to the beam 18.

Figure 10:
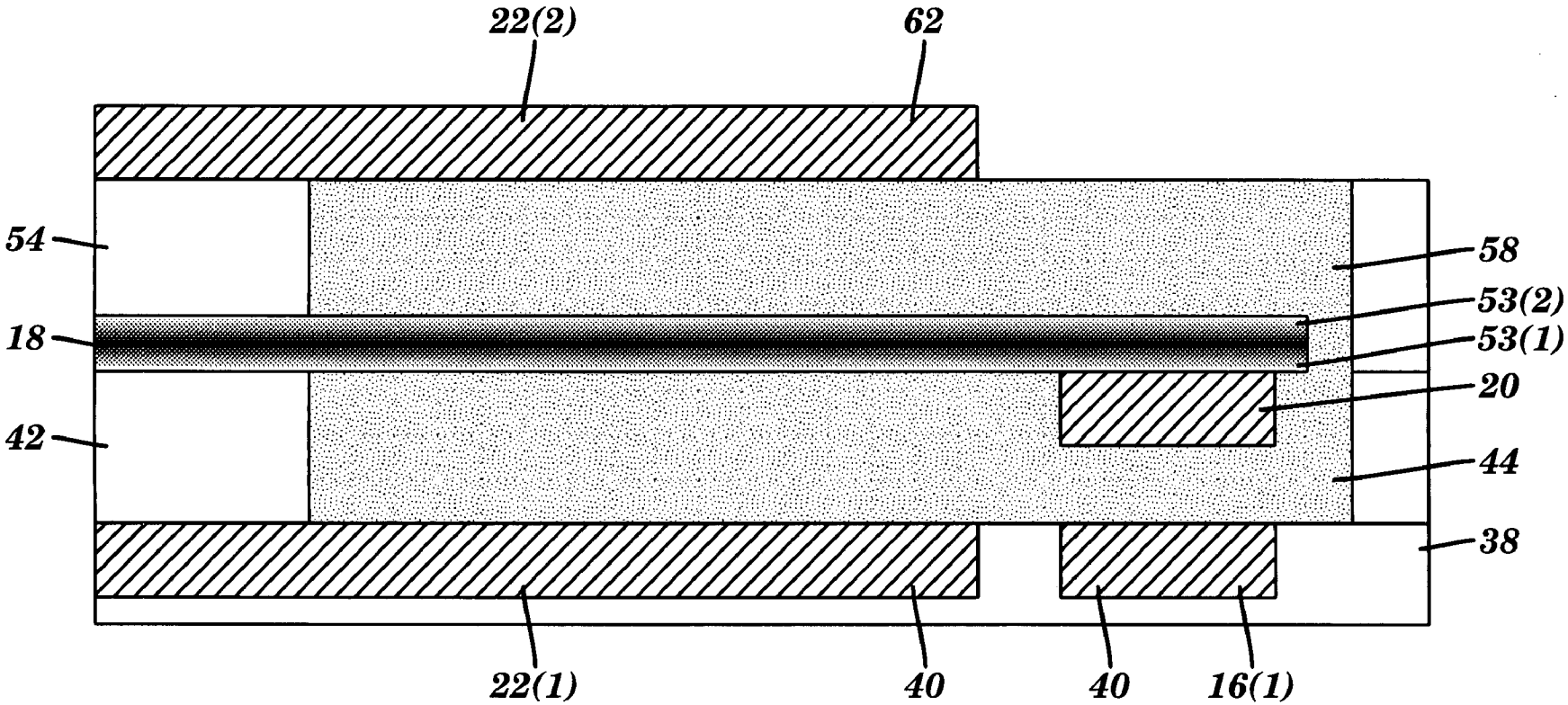

Referring to FIG. 10, a conductive material 62 is deposited over the insulating material 54 and the sacrificial material 58. The conductive material 62 is etched to form a control electrode 22(2) for the switch 10(1). Although in this particular embodiment the control electrode 22(2) is formed by patterning, other techniques for forming the control electrode can be used.

Figure 11:
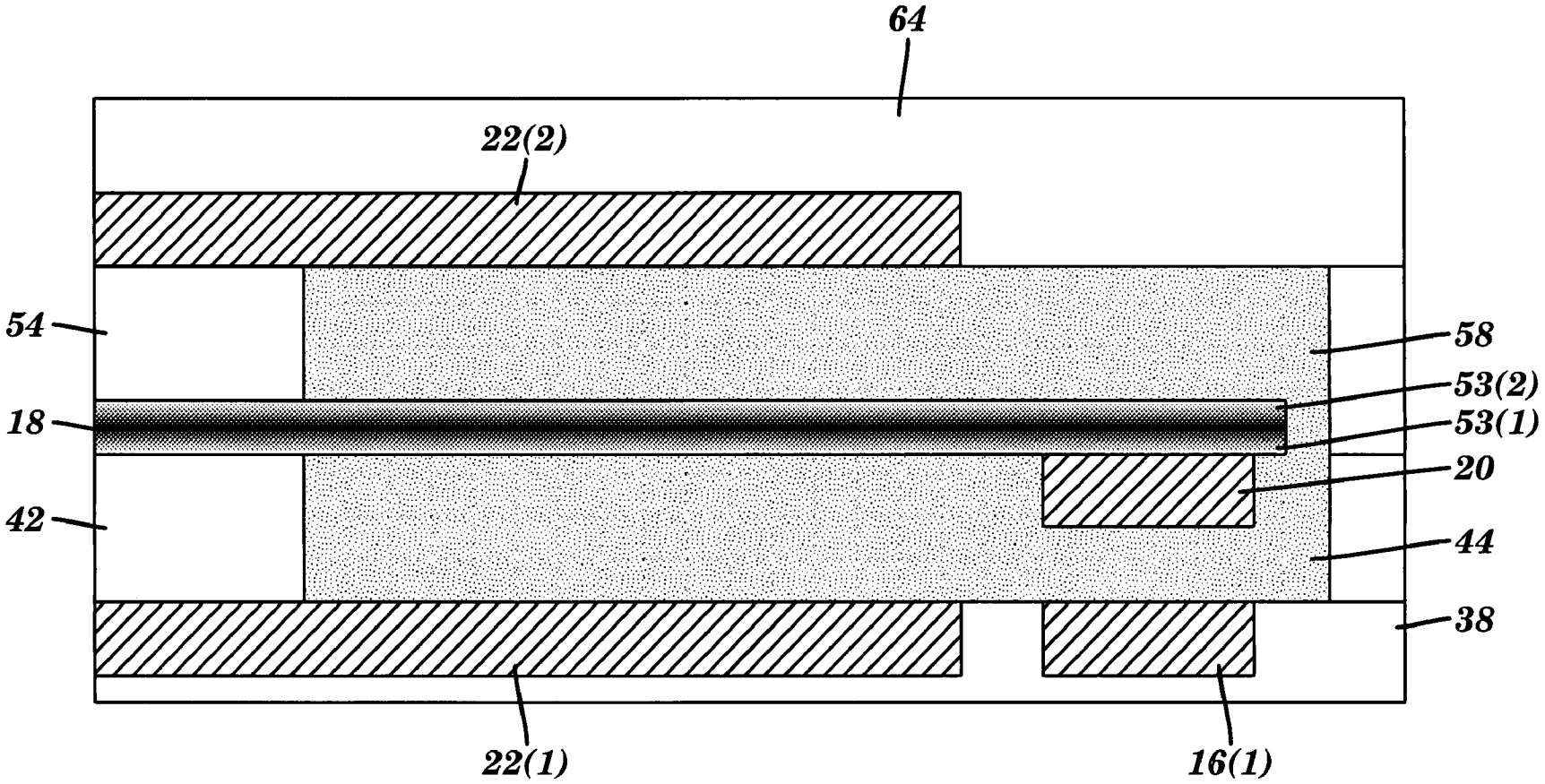

Referring to FIG. 11, once control electrode 22(1) is formed, an insulating material 64 is deposited over the conductive material, the sacrificial material, and the insulating material. The base material 38 and insulating materials 42, 54, and 64 form the switch housing 12 with the chamber 14 which is filled with the sacrificial materials 44 and 58, although switch housing 12 could be made from one or other numbers of layers.

Figure 12:
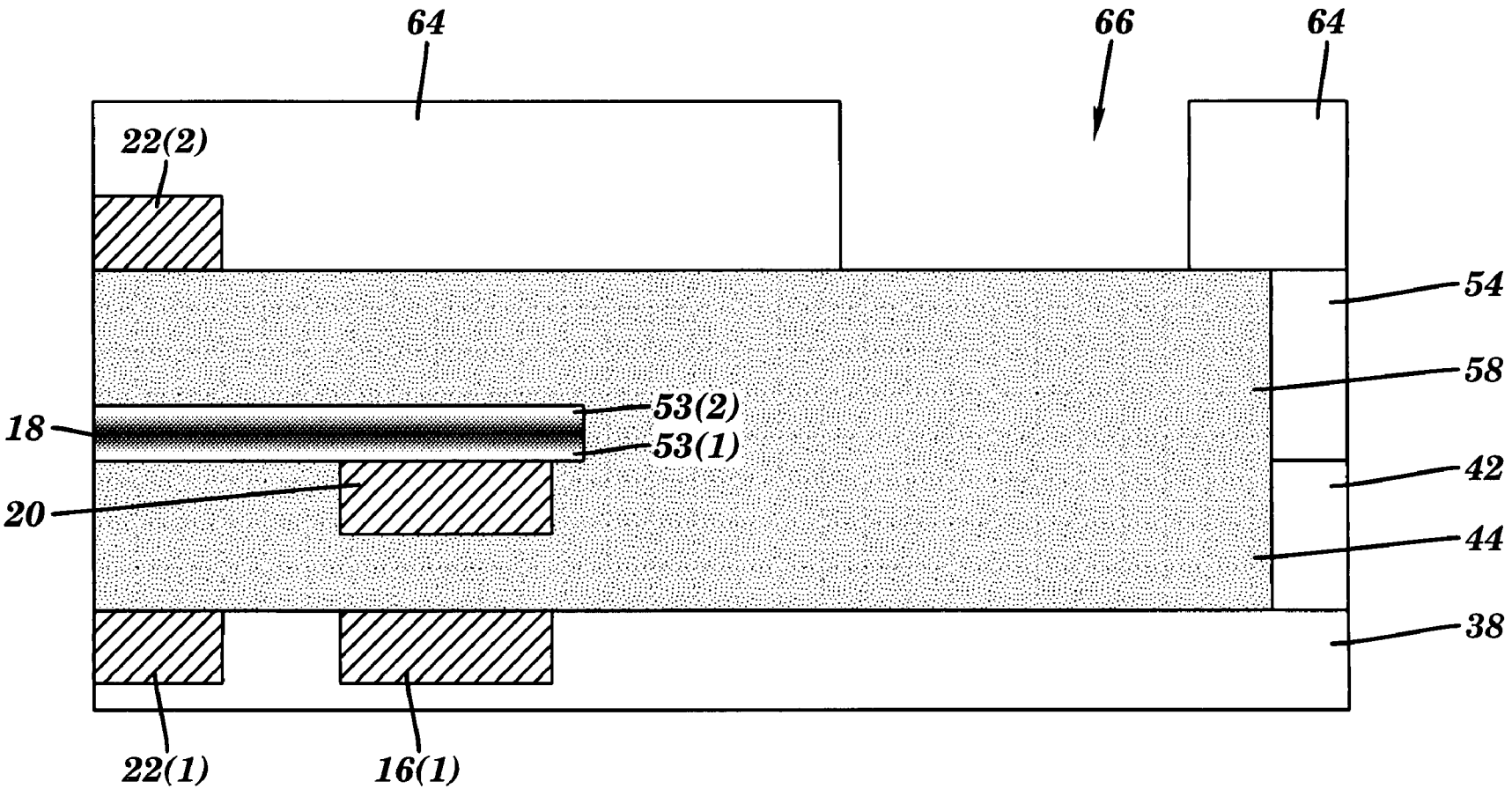
FIGS. 12-14 are partial, cross sectional, top-view of additional steps in the method of making the switch.

Referring to FIG. 12, an access hole 66 is drilled through the insulating layer 64 to the sacrificial material 58. Although in this particular embodiment a single access hole 66 is etched, other numbers of access holes can be formed and the hole or holes can be formed through other materials to the sacrificial material 44 and 58. Contact vias to separated portions 16(1) and 16(2) of the conductive line and control electrodes 22(1) and 22(2) may also be etched or otherwise formed at this time.

Figure 13:
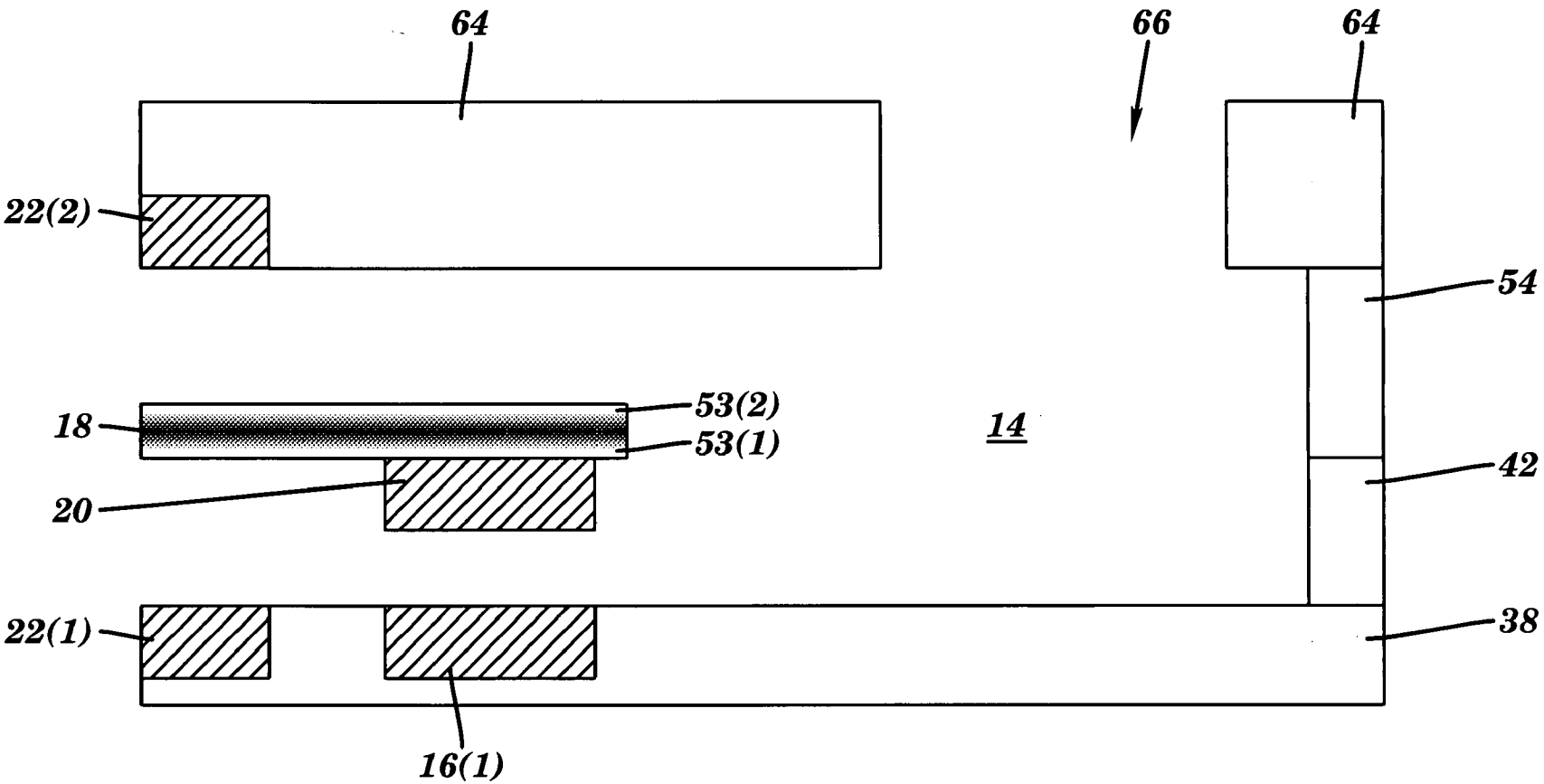

Referring to FIG. 13, once the access hole 66 is formed, the sacrificial materials 44 and 58 removed using xenon difluoride ($XeF_2$) via the access hole 66, although other techniques for removing sacrificial materials 44 and 58 can be used.

Figure 14:
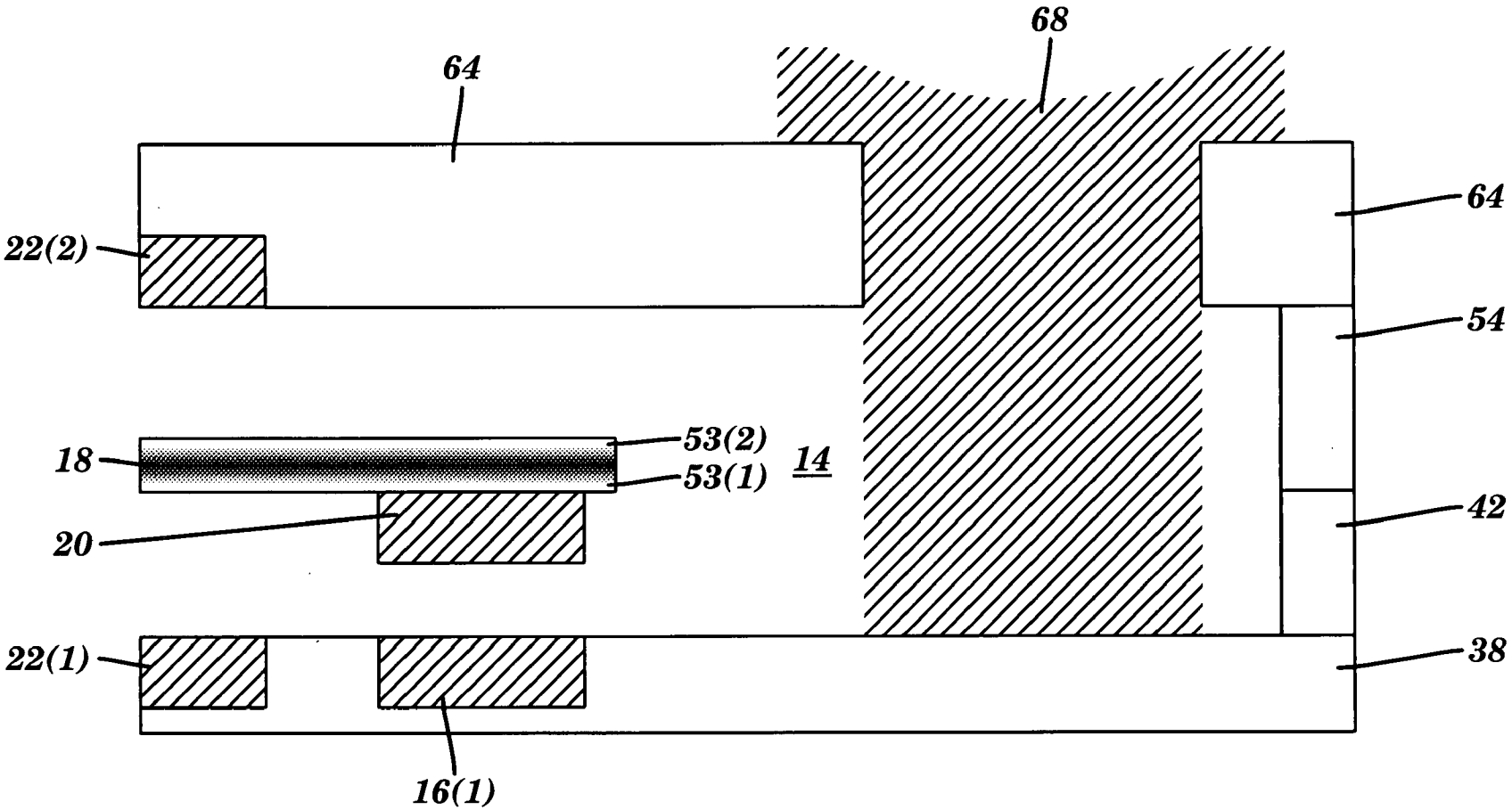

Referring to FIG. 14, once the sacrificial materials 44 and 58 are removed, aluminum is deposited in the access hole 66 to form a plug 68 to seal the chamber 14, although another material or materials can be used for the plug 68. In this embodiment, the chamber 14 is vacuum sealed when the sacrificial materials 44 and 58 are removed and access hole 66 is sealed with a plug 68, although the chamber 14 does not have to be vacuum sealed. Once the chamber 14 is sealed, the switch is ready for use.

Accordingly, the present invention provides a switch that utilizes fixed static charge to apply attractive and repulsive forces for activation and is easy to manufacture. Although one method for making a switch is disclosed, other steps in this method and other methods for making the switch can also be used. For example, other techniques for imbedding charge in the beam can be used, such as applying a bias to the beam to imbed charge.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. A switch comprising:

at least one portion of a conductive line;

a beam comprising two or more insulating layers, wherein one of the two or more insulating layers is located directly on the other one of the two or more insulating layers and the layers hold a fixed, imbedded charge, the beam having a conductive section which is positioned in substantial alignment with the at least one portion of the conductive line, the conductive section of the beam having an open position spaced away from the at least one portion of the conductive line and a closed position on the at least one portion of the conductive line; an control electrodes, each of the control electrodes are spaced away from an opposing side of the beam to control movement of the beam.

2. The switch as set forth in claim 1 further comprising a switch housing with a chamber, the beam extending into the chamber and the at least one portion of a conductive line is in the chamber.

3. The switch as set forth in claim 2 wherein at least one of the control electrodes is located in the chamber.

4. The switch as set forth in claim 2 wherein the control electrodes are all located outside the chamber in the switch housing.

5. The switch as set forth in claim 2 further comprising:

an opening into the chamber; and a plug sealing the opening into the chamber.

6. The switch as set forth in claim 2 wherein the chamber is a vacuum chamber.

7. The switch as set forth in claim 2 wherein the chamber is a filled with at least one gas.

8. The switch as set forth in claim 1 wherein the conductive section is located at or adjacent an end of the beam.

9. The switch as set forth in claim 1 wherein the conductive section is a contactor connected to the beam.

10. The switch as set forth in claim 1 wherein the at least one portion of a conductive line comprises a pair of separated portions of a conductive line, the conductive section is positioned in substantial alignment with the separated portions of the conductive line.

11. The switch as set forth in claim 1 wherein each of the control electrodes are in alignment along at least one axis which extends substantially perpendicularly through the two or more insulating layers of the beam and each of the control electrodes.

12. A method of using a switch, the method comprising:

applying a potential with a first polarity to control electrodes which are spaced away from opposing side of a beam to control movement of the beam, wherein the beam comprises two or more insulating layers, wherein one of the two or more insulating layers is located directly on the other one of the two or more insulating layers and the layers hold a fixed, imbedded charge and the beam has a conductive section which is positioned in substantial alignment with a conductor; and moving the conductive section on the beam to one of an open position spaced away from the conductor or a closed position on the conductor in response to the first polarity of the applied potential.

13. The method as set forth in claim 10 further comprising:

applying a potential with a second polarity to the control electrodes; and moving the conductive section on to one of an open position spaced away from the at least one portion of the conductive line or a closed position on the at least one portion of the conductive line in response to the second polarity of the applied potential.

14. The method as set forth in claim 12 wherein the first polarity is opposite from the second polarity.

15. The method as set forth in claim 12 wherein the beam extends into a chamber in a switch housing and the at least one portion of a conductive line is in the chamber.

16. The method as set forth in claim 15 wherein at least one of the control electrodes is located in the chamber.

17. The method as set forth in claim 15 wherein the control electrodes are all located outside the chamber in the switch housing.

18. The method as set forth in claim 15 wherein the chamber is a vacuum chamber.

19. The method as set forth in claim 15 wherein the chamber is filled with at least one gas.

20. The method as set forth in claim 12 wherein the conductive section is located at or adjacent an end of the beam.

21. The method as set forth in claim 12 wherein the conductive section is a contactor connected to the beam.

22. The method as set forth in claim 12 wherein each of the control electrodes are in alignment along at least one axis which extends substantially perpendicularly through the two or more insulating layers of the beam and each of the control electrodes.

* * * * *